US005588686A

United States Patent [19]

Riley et al.

[11] Patent Number: 5,588,686

[45] Date of Patent: Dec. 31, 1996

[54] TEMPERATURE RESPONSIVE MECHANISM FOR CONTROLLABLY DEADLOCKING A DOOR TO A DOOR FRAME

[75] Inventors: Rory M. Riley, Santa Ana; Alan K. Uyeda, Pico Rivera; Michael Winardi, Rowland Heights, all of Calif.

[73] Assignee: Adams Rite Manufacturing Company, City of Industry, Calif.

[21] Appl. No.: 349,744

[22] Filed: Dec. 5, 1994

[51] Int. Cl.[6] ..... E05B 65/10

[52] U.S. Cl. ..... 292/92; 292/21; 292/DIG. 65; 292/DIG. 66

[58] Field of Search ..... 292/92, 21, DIG. 65, 292/DIG. 66

[56] References Cited

U.S. PATENT DOCUMENTS

| | | | |
|---|---|---|---|
| 1,203,116 | 10/1916 | Hurd . | |
| 1,544,960 | 7/1925 | Watts . | |
| 1,638,748 | 8/1927 | Santee . | |
| 2,458,751 | 1/1949 | Voight . | |
| 2,889,164 | 6/1959 | Clark . | |
| 3,281,176 | 10/1966 | McKey . | |
| 4,083,590 | 4/1978 | Folger . | |
| 4,130,306 | 12/1978 | Brkic . | |
| 4,145,900 | 3/1979 | Ohno | 292/DIG. 66 X |
| 4,183,565 | 1/1980 | Allemann | 292/DIG. 66 X |
| 4,311,329 | 1/1982 | Kral | 292/DIG. 66 X |
| 4,368,905 | 1/1983 | Hirschbein . | |
| 4,458,928 | 7/1984 | Hirschbein . | |
| 4,598,939 | 7/1986 | Krupicka et al. | 292/DIG. 66 X |
| 4,714,285 | 12/1987 | Langham | 292/DIG. 66 X |
| 4,726,613 | 2/1988 | Foshee | 292/DIG. 66 X |
| 4,824,150 | 4/1989 | Smith et al. | 292/DIG. 66 X |
| 4,838,587 | 6/1989 | Choi . | |
| 4,906,034 | 3/1990 | Verslycken | 292/21 X |
| 5,464,259 | 11/1995 | Cohrs et al. | 292/92 |

FOREIGN PATENT DOCUMENTS 2080391 2/1982 United Kingdom .

*Primary Examiner*—Darnell M. Boucher
*Assistant Examiner*—Monica E. Millner
*Attorney, Agent, or Firm*—William W. Haefliger

[57] ABSTRACT

A door locking and unlocking safety mechanism comprising a push mechanism actuator structure to be carried by the door; a single rod operatively connected with the push mechanism to be displaced by operation of the push mechanism; door latch mechanism operable to latch and unlatch the door in response to movement of the single rod; and temperature response blocking structure associated with the latch mechanism to block operation of the latch to unlatch the door, in response to a predetermined increase in ambient temperature.

16 Claims, 4 Drawing Sheets

FIG. 1.
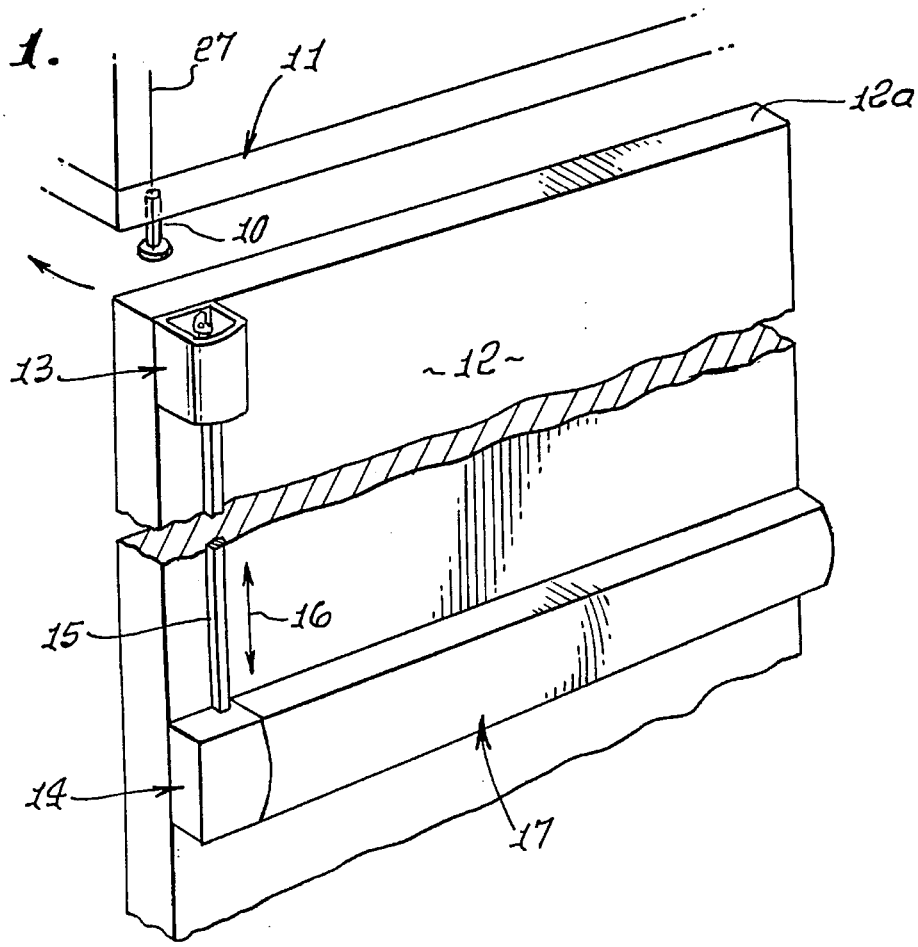
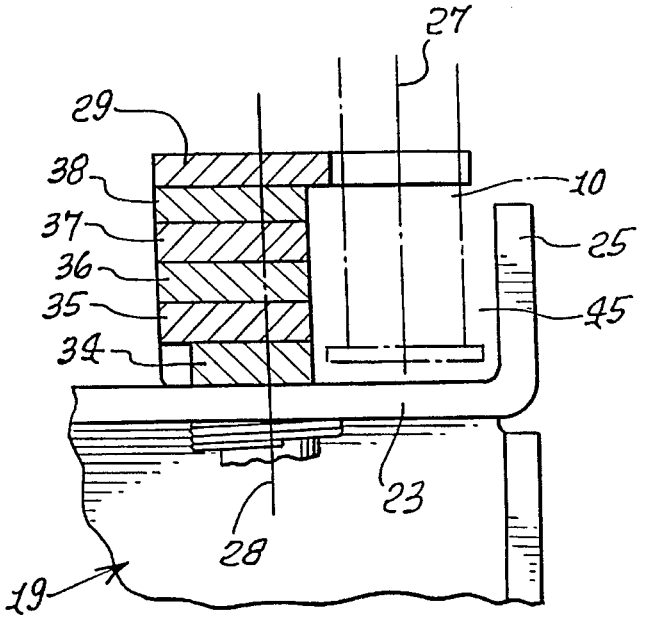
FIG. 6.

TEMPERATURE RESPONSIVE MECHANISM FOR CONTROLLABLY DEADLOCKING A DOOR TO A DOOR FRAME

BACKGROUND OF THE INVENTION

This invention relates generally to a mechanism for deadlocking a door member to a door frame member in such manner as to accommodate sudden opening of the door member as by sudden pushing of an associated panic bar. More particularly, it concerns a temperature responsive mechanism that prevents opening of the door in case of fire.

Safety exit doors are widely used, and they commonly incorporate lock mechanisms which lock the doors to door frames, and which are releasable by operation of panic bars. See U.S. Pat. Nos. 1,638,748; 4,130,306; 4,083,590; and 4,368,905. U.S. Pat. No. 4,838,587 to Choi discloses an improved mechanism for controllably deadlocking a door to a door frame, for panic release.

There is need for simple, compact, reliable mechanisms of this type, which are readily installable upon such doors and door frame members to thereby provide safety exit door operation, and which also block opening of the exit door in case of fire. There is also need for deadlocking mechanisms wherein only one latch and its operating rod are needed on a door, as adjacent the door top.

SUMMARY OF THE INVENTION

It is a major object of the invention to provide door locking and unlocking safety mechanism comprising:

a) a push mechanism actuator means to be carried by the door, b) a single rod operatively connected with the push mechanism to be displaced by operation of the push mechanism, and c) door latch mechanism above the level of said push actuator means, and operable to latch and unlatch the door in response to movement of the single rod, As will be seen, the door latch mechanism is typically on the door, and is the only door latch mechanism on the door.

Also temperature responsive blocking means may be associated with the latch mechanism to block operation of the latch to unlatch the door, in response to a predetermined increase in ambient temperature.

It is another object to provide the temperature responsive blocking means to include a spring-urged element and a heat fusible part blocking spring-urged movement of the element into a position to block rod movement that would otherwise unlatch the door.

It is a further object to provide a single rod to extend in cooperation with a single latch mechanism on the door, and to be movable from a first location in which a latch dog is blocked to prevent pivoting of a latch to release a bolt, to a second location in which the dog is unblocked, to allow latch pivoting. The single rod is typically carried by the door member for endwise vertical movement, there being a shoulder on the rod engageable by the temperature responsive blocking means in response to a predetermined increase in ambient temperature, as during a fire. The single rod is normally movable vertically endwise by the push mechanism actuator means; the latter, however, typically melting at high temperature during a fire, whereby the rod, which would otherwise drop by gravity action, is prevented from dropping by operation of the temperature responsive blocking means.

These and other objects and advantages of the invention, as well as the details of an illustrative embodiment, will be more fully understood from the following specification and drawings, in which:

DRAWING DESCRIPTION

FIG. 1 is a perspective view showing the mechanism of the invention in relation to a panic bar and actuating means therebetween;

FIG. 6 is an elevation showing the bolt captivated position;

DETAILED DESCRIPTION

Figure 3:
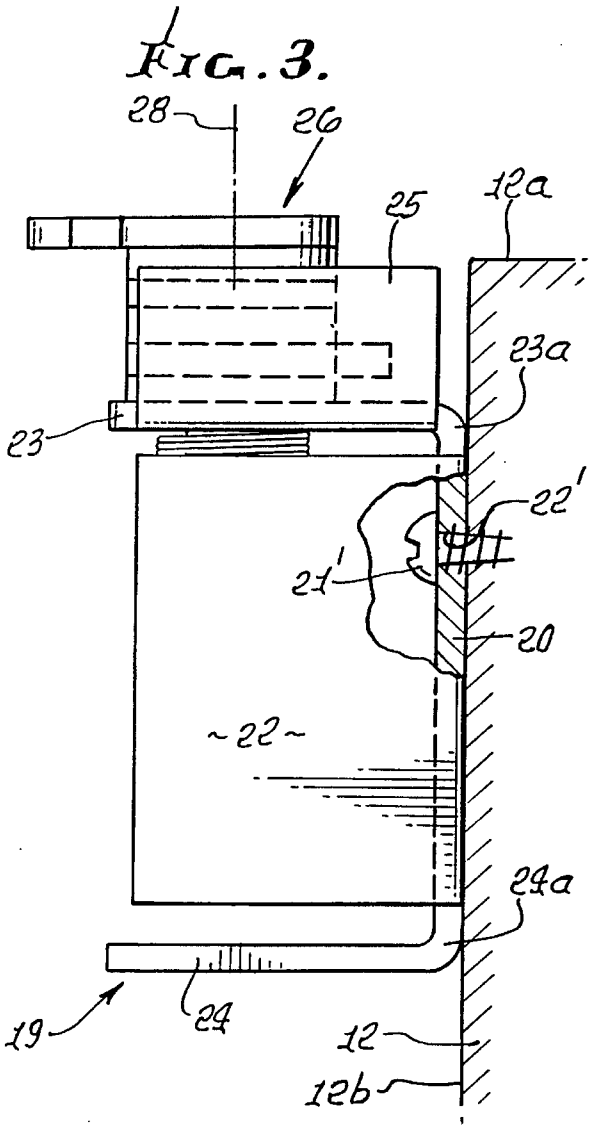
FIG. 3 is a side elevation taken on lines 3—3 of FIG. 2.

In FIG. 1, a locking bolt 10 is carried by, and projects rigidly and freely downwardly from, a door frame upper transverse member 11, i.e., at the general level of the top 12*a* of a door member 12. Mechanism 13, in block form, and incorporating the invention, is attached to the exterior uppermost side 12*b* of the door member. A panic bar 17 extends horizontally and is carried by the door at a lower "manual push" level; and block 14, also carried by the door, represents actuator mechanism between the bar 17 and a vertically movable part 15, such as a single rod acting as a latch blocking and unblocking part, as will appear.

Arrows 16 indicate such rod up and down movement, as controlled by the panic bar. See for example the structure in U.K. Patent No. 2080391A. However, only one latch operating rod, extending above block 14 at 15, is utilized, in the interests of simplicity, safe operation, ease of installation, and lower cost.

Referring now to FIGS. 2–6, the mechanism 13 includes a hollow, metallic, box-like body 19 having a side wall 20 attachable to the side of the door 12, as via fasteners 21' receivable through holes 22' in side wall 20. The body also includes upright flanged walls 21 and 22 integral with wall 20 and bent at 90° thereto. Walls 21 and 22 serve to support wall 23 if and when 23 bends downward under load. Further, the body includes top and bottom flanged walls 23 and 24 integral with wall 20, and bent at 90° thereto. See for example bends 23*a* and 24*a*. A further upright wall 25 is integral with top wall 23, and bent upwardly at 25*a*, for purposes as will appear.

A rotary latching means 26 is carried by the body, and typically by top wall 23, to pivot about an axis 28, which extends parallel to the axis 27 of bolt 10, both axes typically extending vertically. The latching means includes a latch 29 in the form of a plate, which is generally C-shaped in horizontal plane, and forms a recess 30 having a C-shaped inner wall 30*a'* defined by arms 31 and 32 of the C-shaped latch. The recess 30 is adapted to relatively receive the bolt 10 as the door member closes or pivots relatively toward the plane of the door frame member 11, whereby the bolt engages the inner edge 30*a'* of the arm 31, and forcibly pivots the latch plate about the second axis 28, as referred to, and into FIG. 5 position.

In that position, the bolt is confined by the C-shaped latch 29, and also by the upwardly projecting wall 25, referred to above. Thus, the bolt relatively moves from FIG. 4 position to FIG. 5 position, generally parallel to wall 25. In actuality, the wall 25 moves relative to the bolt, which is typically carried by the fixed position frame member 11.

Pivoting of the latch is accommodated by a pivot shaft 33 carried by the top plate 23 to project upwardly, for spacing the latch 29 well above the top plate 23. Spacers 34–38 are mounted on shaft 33, and confined in stacked relation between 23 and 29, as shown. Other spacers may be employed, such as using one mechanism or spacer only. A predetermined torsion spring 40 is located beneath plate 23 and wrapped about shaft 33, to urge, the shaft, latch plate, and spacers in one direction in FIGS. 4 and 5, and toward FIG. 5 position. Thus, as the bolt centers the recess 30, it rotates the latch in the opposite direction, and against the force of the spring, further tensioning the latter. A head 41 on the lower end of the shaft holds the spring between 41 and 23. Torsion spring arm 42 engages the wall 23; and the opposite arm 43 of the spring is attached to the head 41.

Of particular advantage is the fact that the space 45 between the latch plate 29 and the top wall 23 accommodate bolts of different lengths, i.e., that project downwardly to different extents into that space, as the bolt moves relatively into the recess 30 during door closing. Thus, the wide tolerance levels for interengaging parts, upon latching and unlatching, are provided for.

A blocking and unblocking part, as in the form of rod 15 previously referred to, extends in cooperating relation with the body 19. As shown, the polygonal cross section rod 15 extends upwardly into the hollow interior of the body, i.e., between walls 21 and 22, as via polygonal (square) cross section guide openings 47 and 48 through the walls 23 and 24. The rod uppermost extent 15*a* in FIG. 5 extends into laterally blocking relation or with a latch dog 50 integral with and projecting radially outwardly of spacer 35, which is rotatably attached to shaft 33, as via engagement therewith at flat area 51.

When the rod extent 15*a* retracts downwardly below the level of the latch dog, as by panic pushing of the bar 17, the spring urges the latch toward FIG. 4 position, suddenly freeing the latch from the bolt, and allowing rapid opening of the door. Also, the force pushing bar 17 accelerates freeing of the latch from the bolt. Alternatively, when the rod upper extent 15*a* engages the dog 50 at 50*a* in FIG. 5, the door is positively latched to the bolt 10.

Figure 4:
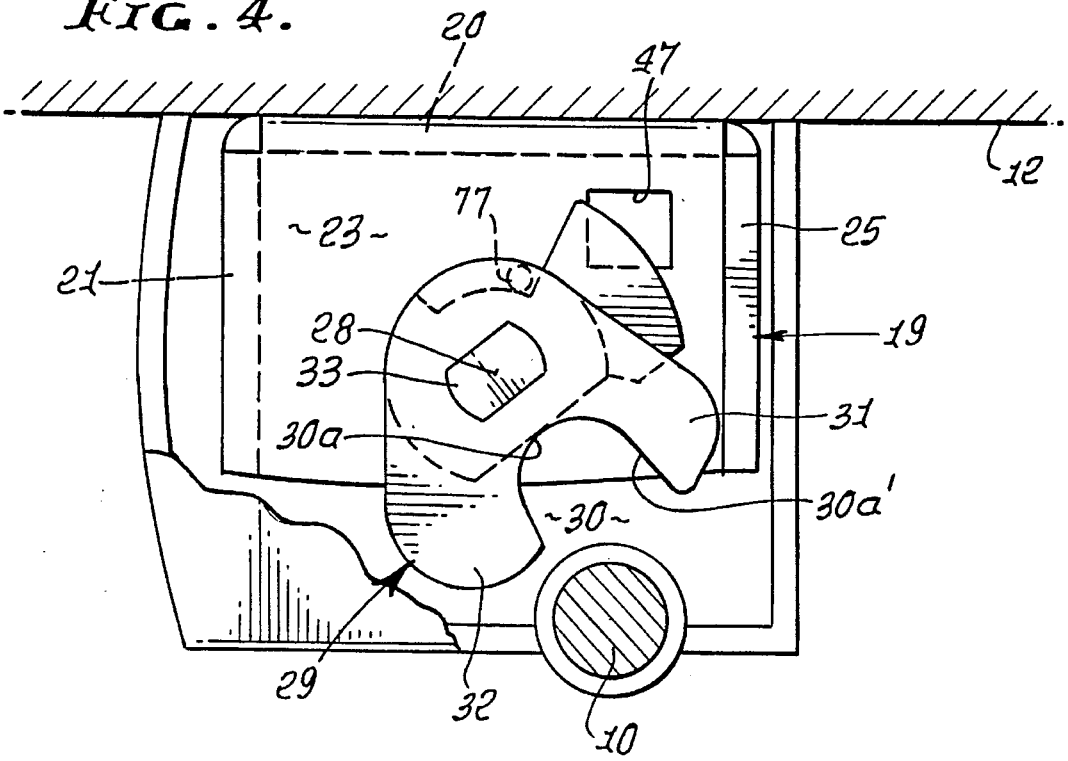
FIG. 4 is a top plan view of lines 4—4 of FIG. 2.
Figure 5:
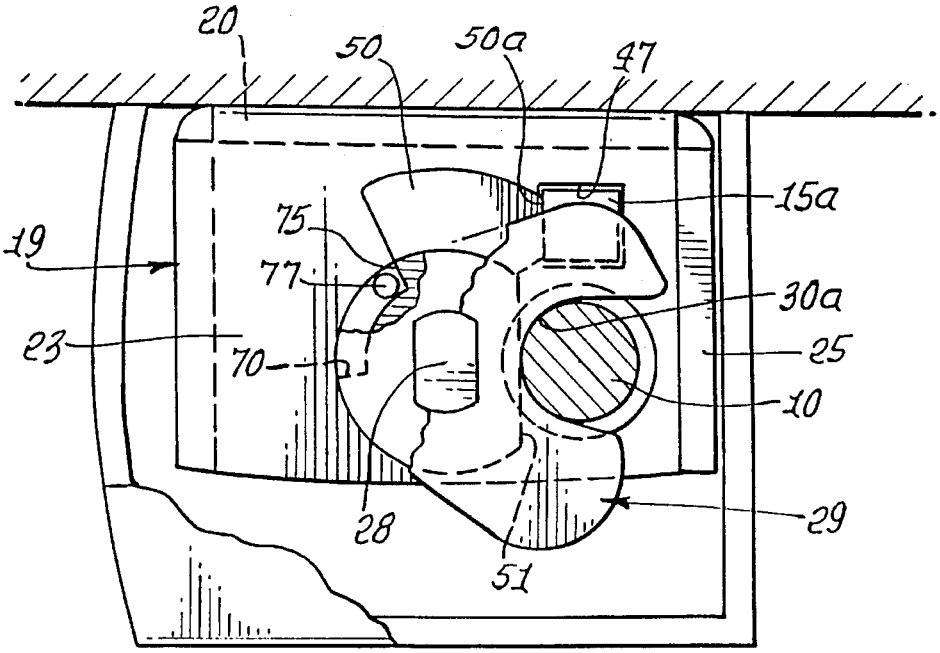
FIG. 5 is a view like FIG. 4 showing a bolt in captivated position.

The plate 34 defines two angularly spaced stops or stop shoulders 70 and 75 (see FIG. 5), alternately engageable with a stop pin 77 integral with top wall 23, thereby to limit rotation of the latch at FIG. 4 and FIG. 5 positions.

Figure 2:
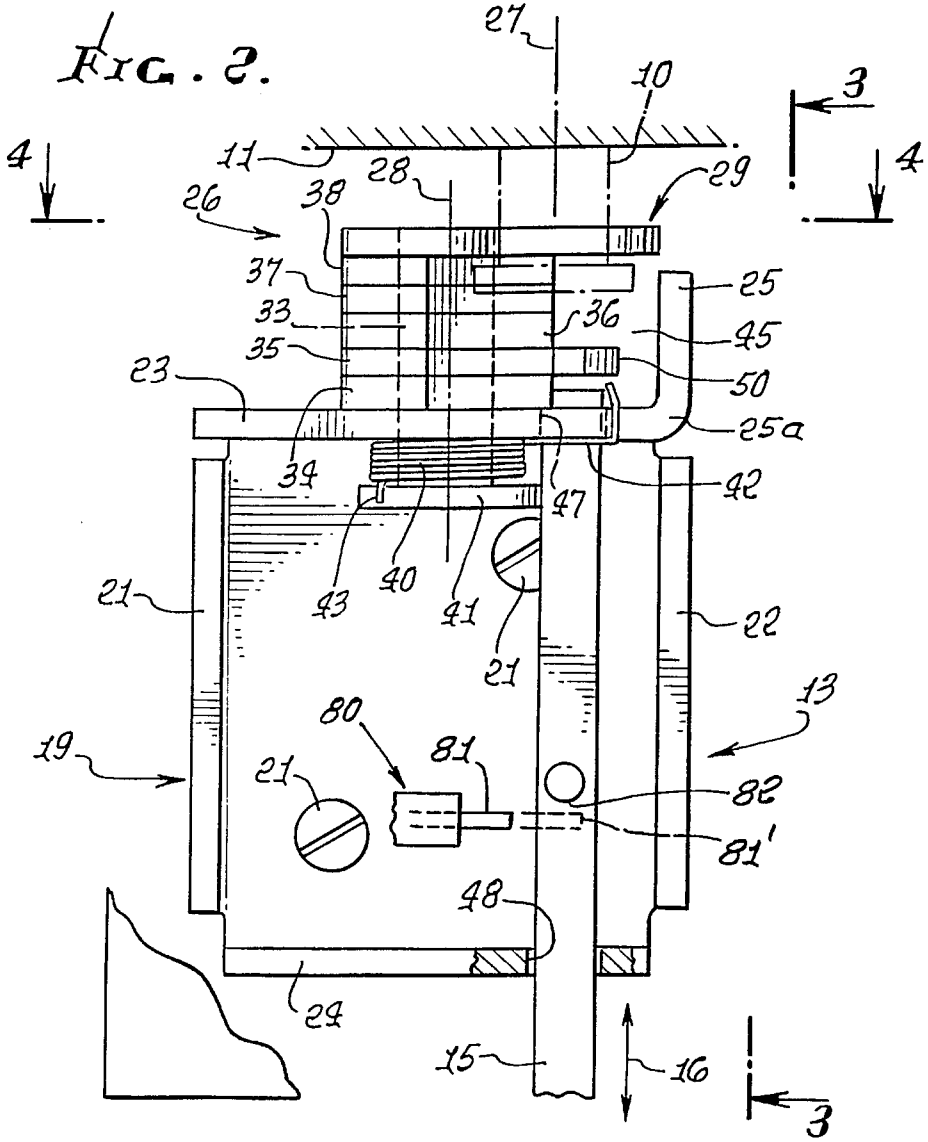
FIG. 2 is a front elevational view of the deadlocking mechanism.

As shown in FIG. 2, temperature responsive blocking means is provided at 80, in association with the latch mechanism, to block operation of the latch to unlatch the door, in response to a predetermined increase in ambient temperature. Device 80 operates to project a blocking part from stored or retracted position, indicated at 81, to extended position, indicated by broken lines 81', in which it projects beneath a shoulder 82 on the rod 15, preventing dropping or lowering of the rod, and thereby preventing unlatching of the mechanism that would otherwise allow opening of the door. This is desired in case of fire, since a closed door blocks the spread of the flames.

The latch mechanism parts and the rod typically consist of steel to resist melting during a fire. Device 80 is indicated generally in FIG. 2, to represent a family or class of usable temperature responsive devices that would prevent rod dropping, i.e., endwise rod movement that would effect unlatching.

Figure 7:
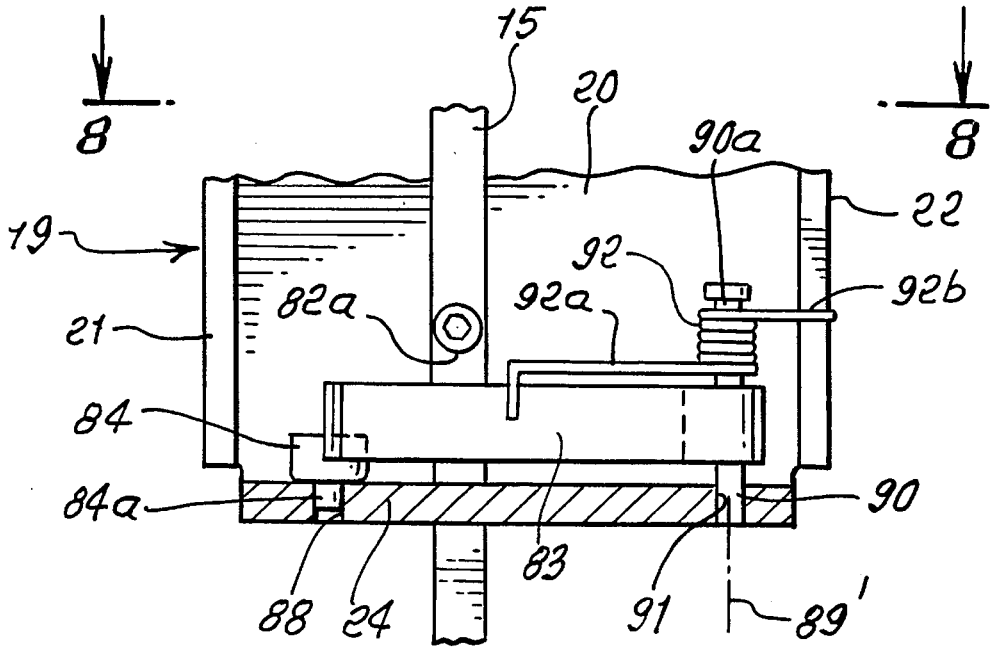
FIG. 7 is an enlarged elevation showing details of a heat fusible rod movement blocking device.
Figure 8:
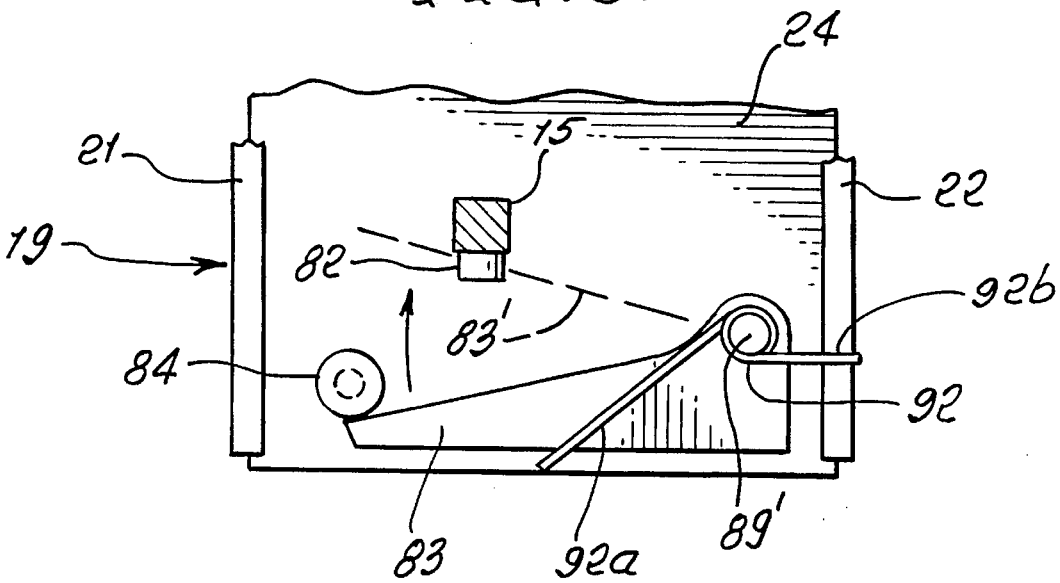
FIG. 8 is a section on lines 8—8 of FIG. 7.

FIGS. 7 and 8 show a particular temperature responsive blocking device, within the family of such devices, as referred to, and which is preferred. As shown, it includes a spring-urged element in the form of an arm 83 pivotally mounted on bottom wall 24, to swing about upright axis 89'. A heat-fusible part 84 normally blocks spring-urged movement of the arm 83 into a position beneath shoulder 82*a* on the rod 15. In that arm released position, indicated by broken lines 83' in FIG. 8, the arm blocks rod downward movement that would otherwise release the door. The panic bar may be melted by the fire, along with rod-actuating mechanism in block 14 (see FIG. 1); however, the rod does not then drop, as by gravity, to unlatch the latch, since the arm 83, released by melting of part 84, then extends beneath rod shoulder 82*a* to prevent rod dropping.

Fusible part 84 may consist of plastic (synthetic resin) that melts at elevated temperatures, such as temperature above 500° F., encountered during a fire. Part 84 is shown as a cylinder having a stem 84*a* received in an opening 88 in bottom wall 24, whereby the cylinder extends in front of the tip of arm 83 to prevent its swinging about axis 89. The arm has a pivot axle 90 also received in an opening 91 in wall 24.

A torsion spring 92 is wound about an upward extension 90*a* of the axle, and urges the arm clockwise in FIG. 8. See torsion spring end 92*a* bearing against the arm 93, and end 92*b* bearing against wall 22. Shoulder 82*a* on the rod may be provided by a steel screw 82 attached to the rod to project outwardly from the rod side, as shown.

We claim:

1. Locking and unlocking safety mechanism, for a door, comprising a) a push mechanism including actuator means to be carried by said door, b) a single rod operatively connected with the push mechanism to be displaced by operation of the push mechanism, c) a single door latch mechanism operable to latch and unlatch said door in response to movement of said single rod, d) said door latch mechanism being on said door, above the level of said push mechanism actuator means, said door latch mechanism being the only door latch mechanism on the door, said push mechanism actuator means being free of any push rod extending therebelow to any other door latch mechanism, e) temperature responsive blocking means associated with the rod and latch mechanism to block operation of the latch mechanism to unlatch said door, in response to a predetermined increase in ambient temperature, f) said temperature responsive blocking means including a spring-urged element and a heat fusible part blocking spring-urged movement of said element into a position to block rod movement that would otherwise unlatch the door, said heat fusible part having a fixed, non-rotatable position, and blocking movement of said element until fusing of said part.

2. The combination of claim 1 wherein said door latch mechanism is operable for deadlocking a door member to a door frame member, one the members rigidly supporting a bolt to project freely in the direction of a first axis, for captivation by said door latch mechanism, said door latch mechanism comprising:

i) a body attachable to the other member, ii) a rotary latching means carried by the body to pivot about a second axis generally parallel to the first axis, the latching means including a latch forming a recess to relatively receive the bolt as the members relatively close and so that the bolt pivots the latch about the second axis into full latching position, thereby to deadlock the two members, iii) a confinement wall on the body to face and confine the bolt in said recess in said full latching position, iv) the latch mechanism including a latch dog, v) said rod extending in cooperation with the body and movable from a first location in which the latch dog is blocked to prevent pivoting of the latch to release the bolt, to a second location in which the dog is unblocked, to allow said latch pivoting.

3. Locking and unlocking safety mechanism, for a door, comprising a) push mechanism including actuator means to be carried by said door, b) a single rod operatively connected with the push mechanism to be displaced by operation of the push mechanism, c) a single door latch mechanism operable to latch and unlatch said door in response to movement of said single rod, d) said door latch mechanism being on said door, above the level of said push mechanism actuator means, said door latch mechanism being the only door latch mechanism on the door, said push mechanism actuator means being free of any push rod extending therebelow to any other door latch mechanism, e) temperature responsive blocking means associated with the rod and latch mechanism to block operation of the latch mechanism to unlatch said door, in response to a predetermined increase in ambient temperature, f) said mechanism being operable for deadlocking a door member to a door frame member, one the members rigidly supporting a bolt to project freely in the direction of a first axis, for captivation by said door latch mechanism, said door latch mechanism comprising:

i) a body attachable to the other member, ii) a rotary latching means carried by the body to pivot about a second axis generally parallel to the first axis, the latching means including a latch forming a recess to relatively receive the bolt as the members relatively close and so that the bolt pivots the latch about the second axis into full latching position, thereby to deadlock the two members, iii) a confinement wall on the body to face and confine the bolt in said recess in said full latching position, iv) the latch mechanism including a latch dog;

v) said rod extending in cooperation with the body and movable from a first location in which the latch dog is blocked to prevent pivoting of the latch to release the bolt, to a second location in which the dog is unblocked, to allow said latch pivoting.

g) said rod being adapted to be carried by said other member for endwise movement relative thereto, there being a shoulder on the rod engageable by said temperature responsive blocking means in response to a predetermined increase in said ambient temperature, said temperature responsive blocking means comprising a heat fusible part having a fixed, non-rotatable position relative to said confinement wall.

4. The mechanism of claim 3 including said other member which comprises the door member, said body is attached to upper extent of the door member, and said rod extends generally vertically and is adapted to be displaced endwise vertically by said push mechanism actuator means, said temperature responsive blocking means includes an arm having an axis of rotation generally parallel to said rod, and engaging said fixed position heat fusible part.

5. The mechanism of claim 4 including said actuator means in the form of a panic bar carried by intermediate extent of the door member and operatively connected to the elongated rod for displacing that rod up and down.

6. The mechanism of claim 2 including interengageable stops on the body and on said rotary latching means to limit rotation of the latch in one rotary direction about said second axis at said full latching position, and in the opposite rotary direction about said second axis at a bolt-releasing position.

7. The mechanism of claim 2 wherein the latching means is rotatable in one direction about said second axis toward said full latching position, and in the opposite rotary direction about said second axis toward and into bolt-releasing position, and including a spring associated with said body and rotary latching means for urging the rotary latching means toward said bolt-releasing position.

8. The combination of claim 7 wherein said spring is a torsion spring extending about a shaft defined by said rotary latching means.

9. The combination of claim 2 wherein said rotary latching means includes a rotary shaft carrying said latch in the form of a latch plate forming said recess, the shaft carried by the body to extend upright in said second direction.

10. The combination of claim 2 including said bolt carried by the door frame member to project downwardly into said recess.

11. The combination of claim 8 wherein the body includes a side wall attachable to one of said members, a top wall relative to which said confinement wall projects upwardly proximate one end of the top wall, there being an upright shaft mounted on the top wall and mounting said latching means above said top wall to rotate at a level proximate the top of said confinement wall.

12. The mechanism of claim 2 including a second wall on the body facing the confinement wall, said walls extending upright, a generally horizontal upper wall on the body and carrying the latching means, said second wall and confinement wall extending upwardly to support the upper wall under sufficient downward loading exerted on the upper wall.

13. The combination of claim 1 wherein said spring-urged element comprises a pivoted arm, and there being a torsion spring urging said arm in a swing direction toward the rod, and said heat fusible part is carried by a latch body to project in the path of arm swinging toward the rod.

14. The combination of claim 13 including a downwardly facing shoulder on the rod and beneath which the arm is swung by the torsion spring in response to heat fusing of said part.

15. Locking and unlocking safety mechanism, for a door, comprising a) a push mechanism actuator means to be carried by said door, b) a single rod operatively connected with the push mechanism to be displaced by operation of said push mechanism, c) door latch mechanism operable to latch and unlatch said door in response to movement of said single rod, d) and temperature responsive blocking means associated with the latch mechanism to block operation of the latch to unlatch the door, in response to a predetermined increase in ambient temperature, e) said temperature responsive blocking means including a fixed position, non-rotary, heat fusible part, and a pivoted arm engaging said part and having an axis of pivoting generally parallel to said arm, and operable to block displacement of said rod.

16. Locking and unlocking safety mechanism, for a door, comprising a) a push mechanism actuator means to be carried by said door, b) a rod operatively connected with the push mechanism to be displaced by operation of said push mechanism, c) door latch mechanism operable to latch and unlatch said door in response to movement of said rod, d) and temperature responsive blocking means associated with the latch mechanism to block operation of the latch to unlatch the door, in response to a predetermined increase in ambient temperature, e) said temperature responsive blocking means including a fixed position, non-rotary, heat fusible part, and a pivoted arm engaging said part and having an axis of pivoting generally parallel to said arm, and operable to block displacement of said rod.

* * * * *